US010420969B2

(12) United States Patent
Rogers et al.

(10) Patent No.: US 10,420,969 B2
(45) Date of Patent: Sep. 24, 2019

(54) COMMERCIAL AVIATION FIRE EXTINGUISHER—STRENGTH INCREASE METHOD FOR IN SERVICE AND OEM FIRE PROTECTION

(71) Applicant: Kidde Technologies, Inc., Wilson, NC (US)

(72) Inventors: Aaron Stanley Rogers, Surf City, NC (US); Dharmendr Len Seebaluck, Wake Forest, NC (US)

(73) Assignee: Kidde Technologies, Inc., Wilson, NC (US)

( * ) Notice: Subject to any disclaimer, the term of this patent is extended or adjusted under 35 U.S.C. 154(b) by 0 days.

(21) Appl. No.: 15/786,262

(22) Filed: Oct. 17, 2017

(65) Prior Publication Data

US 2019/0111292 A1 Apr. 18, 2019

(51) Int. Cl.

| | |
|---|---|
| ***A62C 35/02*** | (2006.01) |
| ***A62C 3/08*** | (2006.01) |
| ***B65D 25/34*** | (2006.01) |

(52) U.S. Cl.

CPC ..... *A62C 35/023* (2013.01); *A62C 3/08* (2013.01); *B65D 25/34* (2013.01)

(58) Field of Classification Search

CPC ..... A62C 35/023; A62C 3/08; A62C 31/28; A62C 35/02; A62C 99/009; B65D 25/34

USPC ..... 169/53, 74, 89, 34, 62

See application file for complete search history.

(56) References Cited

U.S. PATENT DOCUMENTS

| | | | | | |
|---|---|---|---|---|---|
| 2,732,017 | A * | 1/1956 | Fleming | A62C 3/00 | 169/5 |
| 2,779,421 | A * | 1/1957 | Rust | B64D 1/16 | 169/26 |
| 3,375,875 | A * | 4/1968 | Wesson | A62C 13/006 | 169/74 |
| 3,552,495 | A * | 1/1971 | Fiero | A62C 35/08 | 169/28 |
| 4,113,132 | A | 9/1978 | Steiner | | |
| 4,197,915 | A * | 4/1980 | Martin | A62C 13/64 | 169/72 |

(Continued)

FOREIGN PATENT DOCUMENTS

| | | |
|---|---|---|
| CN | 2126807 Y | 2/1993 |
| CN | 202191621 U | 4/2012 |

(Continued)

OTHER PUBLICATIONS

Photo — Fiber wound flotation vessel, Kidde Graviner (now L'Hotellier), early 2000s.

(Continued)

*Primary Examiner* — Christopher S Kim

(74) *Attorney, Agent, or Firm* — Kinney & Lange, P.A.

(57) ABSTRACT

A fire extinguisher vessel includes a hollow body made of stainless steel, a fill port attached to a first end of the body, a discharge outlet attached to a second end of the body, a mechanical attachment lug attached to the body between the first end of the body and the second end of the body, a pressure switch attached to the body between the mechanical attachment lug and the discharge outlet, and a wrap covering the body. The wrap is flush with the fill port, the discharge outlet, the mechanical attachment lug, and the pressure switch.

19 Claims, 1 Drawing Sheet

(56) References Cited

U.S. PATENT DOCUMENTS

| | | | | |
|---|---|---|---|---|
| 5,385,208 | A * | 1/1995 | Baker | A62C 3/0242 169/46 |
| 6,209,593 | B1 * | 4/2001 | Nichols, Sr. | B64D 1/16 141/2 |
| 6,796,382 | B2 * | 9/2004 | Kaimart | A62C 3/025 169/26 |
| 8,342,252 | B2 * | 1/2013 | Alzemi | A62C 37/12 169/26 |
| 8,356,676 | B2 * | 1/2013 | Casals | B64D 1/16 169/53 |
| 8,800,675 | B2 * | 8/2014 | Machado | A62C 3/08 169/30 |
| 2006/0175067 | A1 * | 8/2006 | Cover | A62C 13/76 169/30 |
| 2007/0209809 | A1 * | 9/2007 | Jacobson | A62C 13/78 169/73 |
| 2008/0289831 | A1 * | 11/2008 | Kaimart | A62C 19/00 169/36 |
| 2011/0180279 | A1 * | 7/2011 | Feller | A62C 13/76 169/51 |
| 2016/0340107 | A1 | 11/2016 | Har-Shai | |
| 2017/0146477 | A1 | 5/2017 | Di Sarno | |

FOREIGN PATENT DOCUMENTS

| | | | |
|---|---|---|---|
| WO | WO 9300961 | A1 | 1/1993 |
| WO | WO2013184285 | A1 | 12/2013 |
| WO | WO2017110902 | A1 | 6/2017 |

OTHER PUBLICATIONS

Photo — Commercial aviation cargo bay fire suppression bottle, Kidde Aerospace, mid 1990s.

Pre-Search Communication for European Patent Application No. 18200505.8 dated Mar. 21, 2019, 7 pages.

Anonymous: "First Revision No. 3-NFPA 2001-2016 [Section No. 1.3] Committee Statement National Fire Protection Association Report" May 11, 2016, pp. 1-89, XP055603691.

Pat B. Mclaughlan et al: "Composite Overwapped Pressure Vessels, a Primer", Oct. 15, 2011, XP055166520.

Extended European Search Report for European Patent Application No. 18200505.8, dated Jul. 17, 2019, 13 pages.

* cited by examiner

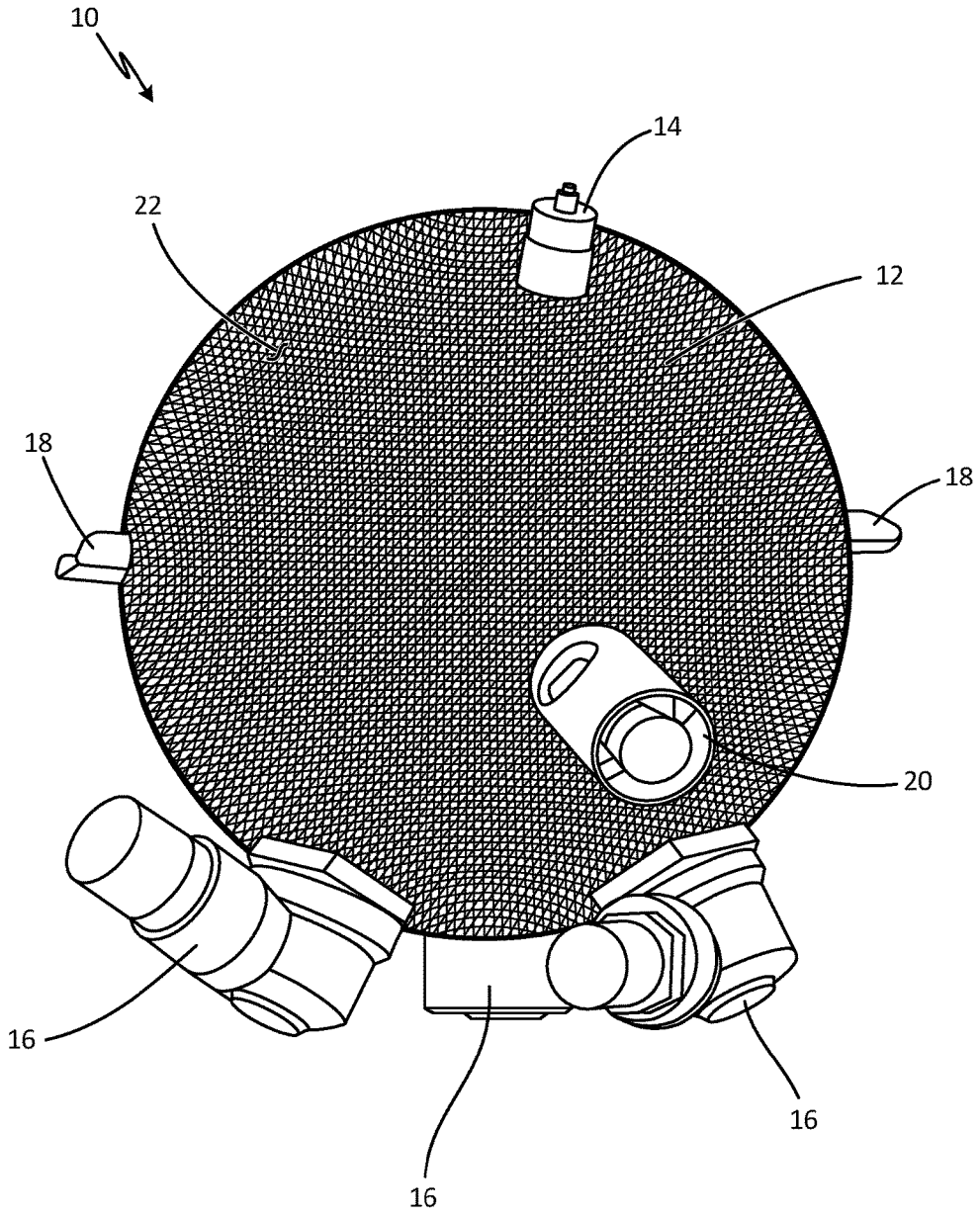
10
14
22
12
18
18
20
16
16
16

COMMERCIAL AVIATION FIRE EXTINGUISHER—STRENGTH INCREASE METHOD FOR IN SERVICE AND OEM FIRE PROTECTION

BACKGROUND

The present disclosure relates to fire suppression systems, and in particular, to fire extinguisher vessels.

Aircraft fire suppression systems incorporate pressurized fire extinguisher vessels containing fire extinguishing agent. The fire extinguisher vessels are installed into the cargo bay or the engine/APU areas of the aircraft. Current fire suppression systems on aircraft use Halon as the fire extinguishing agent, and therefore the fire extinguisher vessels are built to accommodate Halon. Because Halon is a very efficient fire extinguishing agent, less Halon is required to extinguish a fire than other less efficient fire extinguishing agents. As a result, current fire extinguisher vessels on aircraft may not be capable of incorporating sufficient fire extinguishing agents other than Halon.

SUMMARY

A fire extinguisher vessel includes a hollow body made of stainless steel, a fill port attached to a first end of the body, a discharge outlet attached to a second end of the body, a mechanical attachment lug connected to the body between the first end of the body and the second end of the body, a pressure switch attached to the body between the mechanical attachment lug and the discharge outlet, and a wrap covering the body. The wrap is flush with the fill port, the discharge outlet, the mechanical attachment lug, and the pressure switch.

A fire extinguisher vessel includes a hollow body made of stainless steel, a fill port attached to a first end of the body, a discharge outlet attached to a second end of the body, a mechanical attachment lug attached to the body between the first end of the body and the second end of the body, a pressure switch attached to the body between the mechanical attachment lug and the discharge outlet, and a wrap covering the body. The wrap comprises high strength fiberglass. The fire extinguisher vessel has an agent fill density of at least about 0.026 pounds per cubic inch.

A method of retrofitting a fire extinguisher vessel includes removing a fire extinguisher vessel from a location on an aircraft. The fire extinguisher vessel includes a hollow body made of stainless steel, a fill port attached to a first end of the body, a discharge outlet attached to a second end of the body, a mechanical attachment lug attached to the body between the first end of the body and the second end of the body, and a pressure switch attached to the body between the mechanical attachment lug and the discharge outlet. The method further includes wrapping a high strength fiberglass wrap around the body and reinstalling the fire extinguisher vessel into the location on the aircraft.

BRIEF DESCRIPTION OF THE DRAWINGS

FIG. 1 is an isometric view of a fire extinguisher vessel.

DETAILED DESCRIPTION

In general, the present disclosure describes a fire extinguisher vessel for an aircraft that has been retrofitted with a wrap comprising high strength fiberglass, such as carbon fiber nano-tube, in order to increase the agent fill density of the fire extinguisher vessel such that the fire extinguisher vessel is capable of containing a higher volume of fire extinguishing agent. The wrap surrounds the appendages of the fire extinguisher vessel such that the wrap is flush with the appendages. The retrofitted vessel is capable of being reinstalled in the same place on the aircraft from which it was removed prior to being fitted with the wrap.

FIG. 1 is an isometric view of fire extinguisher vessel 10. Fire extinguisher vessel 10 includes body 12, fill port 14, discharge outlets 16, mechanical attachment lugs 18, pressure switch 20, and wrap 22.

Fire extinguisher vessel 10 has hollow spherical body 12. Body 12 is a stainless steel container. Body 12 may be made of a nitrogen strengthened stainless steel alloy such as Nitronic 40, or any other suitable stainless steel. In alternate embodiments, body 12 may be an elongated sphere, cylinder with rounded edges, or any other suitable shape. Fill port 14 is attached to an exterior surface of body 12 at a first end of body 12. Discharge outlets 16 are attached to the exterior surface of body 12 at a second end of body 12. In this embodiment, fire extinguisher vessel 10 has three discharge outlets 16. In alternate embodiments, fire extinguisher vessel 10 may have more or less than three discharge outlets 16. Mechanical attachment lugs 18 are connected to the exterior surface body 12 between the first end of body 12 and the second end of body 12. Mechanical attachment lugs 18 are spaced from one another along a circumference of body 12. In this embodiment, fire extinguisher vessel 10 includes three mechanical attachment lugs 18. In alternate embodiments, fire extinguisher vessel 10 may have more or less than three mechanical attachment lugs 18. Mechanical attachment lugs 18 may be U-channel lugs or any other suitable mechanical attachment lugs. Pressure switch 20 is attached to the exterior surface of body 12 between discharge outlets 16 and mechanical attachment lugs 18.

Wrap 22 is positioned on the exterior surface of body 12 such that it covers the exterior surface of body 12. Wrap 22 is flush with fill port 14, discharge outlets 16, mechanical attachment lugs 18, and pressure switch 20. As such, wrap 22 completely surrounds fill port 14, discharge outlets 16, mechanical attachment lugs 18, and pressure switch 20 with no spaces existing between wrap 22 and a base of fill port 14, wrap 22 and bases of discharge outlets 16, wrap 22 and bases of mechanical attachment lugs 18, or wrap 22 and a base of pressure switch 20. Wrap 22 is made up of a high strength fiberglass material such as carbon fiber nano-tubes or carbon fiber reinforced fiberglass. Wrap 22 has a thickness between about 0.0625 inch (0.15875 centimeter) and about 0.125 inch (0.3175 centimeter). Wrap 22 is wrapped around body 12 along all three orthogonal axes of body 12, including along the x-axis, the y-axis, and the z-axis. A machine may be used to wrap wrap 22 around fire extinguisher vessel 10, the machine possibly including rollers over which wrap 22 is initially stretched. Fire extinguisher vessel 10 has a post installation agent fill density of at least about 0.026 pounds per cubic inch (0.00072 kilograms per cubic centimeter) and up to about 0.0336 pounds per cubic inch (0.000929 kilograms per cubic centimeter).

Fill port 14 is utilized to fill hollow body 12 with liquid fire extinguishing agent under pressure. When a cartridge inside body 12 is activated, shock waves are sent into body 12, causing a diaphragm, or burst disc, inside body 12 to rupture and discharge the fire extinguishing agent that is being held under pressure. The fire extinguishing agent exits body 12 from the hollow portion of body 12 via discharge outlets 16. Mechanical attachment lugs 18 are used to mount fire extinguisher vessel 10 to a location within an aircraft.

Pressure switch 20 monitors the pressure of fire extinguisher vessel 10 on the aircraft to identify if a leak occurs. Because wrap 22 is flush with fill port 14, discharge outlets 16, mechanical attachment lugs 18, and pressure switch 20, there are no localized stresses created in fire extinguisher vessel 10. Wrap 22 is wrapped along all three orthogonal axes to increase the strength of wrap 22.

Halon is currently used as the fire extinguishing agent onboard aircraft. Halon is a very efficient fire extinguishing agent. However, Halon is also recognized as depletory to the ozone, contributing to the global warming effect. As a result, Halon is not being manufactured anymore and is not used in most applications. Other known fire extinguishing agents, such as, for example, nitrogen, carbon dioxide, and HFC125, are less efficient than Halon. A higher volume of such less efficient agents is required for fire extinguishing. Most existing fire extinguisher vessels, which have been built for use with Halon, would need to be filled with a higher volume of less efficient fire extinguishing agent than they have been rated to accommodate.

In order to retrofit an existing fire extinguisher vessel for use with an agent other than Halon, an existing fire extinguisher vessel, which has an agent fill density of about 0.0289 pounds per cubic inch (0.0008 kilograms per cubic centimeter), is removed from an aircraft and wrapped with wrap 22. Incorporating wrap 22 onto an existing fire extinguisher vessel significantly increases the agent fill density of the fire extinguisher vessel to at least about 0.026 pounds per cubic inch (0.00072 kilograms per cubic centimeter) and up to about 0.0336 pounds per cubic inch (0.000929 kilograms per cubic centimeter), without disturbing the fill port, discharge outlets, mechanical attachment lugs, or pressure switch, which are still exposed and not covered by wrap 22. When the fire extinguishing vessel is refilled with a less efficient fire extinguishing agent, a new pressure switch and a new diaphragm, or burst disc, with higher pressure settings are installed. Retrofit fire extinguisher vessel 10 is then reinstalled into the location of the aircraft from which it was removed, fitting into the same space and using the same attachment mechanisms on the aircraft. As a result, the location of fire extinguisher vessel 10 on an aircraft does not require modification.

Because fire extinguisher vessel 10 has a higher agent fill density, fire extinguisher vessel 10 can be filled with a greater volume of less efficient liquid fire extinguishing agent while the size of fire extinguisher vessel 10 remains the same. As such, fire extinguisher vessel 10 can provide the same level of fire protection using a less efficient fire extinguishing agent. At the same time, fire extinguisher vessel 10 remains the appropriate size and continues to have the appropriate non-obstructed appendages necessary to be mountable or reinstalled into the same place on the aircraft, likely using the same existing brackets on the aircraft. Further, because wrap 22 can be installed to an existing fire suppression vessel, fire suppression vessel 10 can be wrapped with wrap 22 at a repair facility or during routine maintenance, reducing cost and time required to switch fire suppression agents on an aircraft.

Discussion of Possible Embodiments

The following are non-exclusive descriptions of possible embodiments of the present invention.

A fire extinguisher vessel including a hollow body made of stainless steel; a fill port attached to a first end of the body; a discharge outlet attached to a second end of the body; a mechanical attachment lug connected to the body between the first end of the body and the second end of the body; a pressure switch attached to the body between the mechanical attachment lug and the discharge outlet; and a wrap covering the body, wherein the wrap is flush with the fill port, the discharge outlet, the mechanical attachment lug, and the pressure switch.

The fire extinguisher vessel of the preceding paragraph can optionally include, additionally and/or alternatively, any one or more of the following features, configurations and/or additional components:

The wrap comprises high strength fiber glass.

The wrap comprises carbon fiber reinforced fiberglass.

The wrap comprises carbon fiber nano-tubes.

The body is spherical.

The fire extinguisher vessel includes a plurality of mechanical attachment lugs connected to the body between the first end of the body and the second end of the body; and a plurality of discharge outlets attached to a second end of the body.

The fire extinguisher vessel has an agent fill density of at least about 0.026 pounds per cubic inch.

The body comprises a nitrogen strengthened stainless steel alloy.

The fire extinguisher vessel has an agent fill density of up to about 0.0336 pounds per cubic inch.

The wrap has a thickness between about 0.0625 inch and about 0.125 inch.

The wrap covers the body along all three orthogonal axes of the body.

A fire extinguisher vessel including a hollow body made of stainless steel; a fill port attached to a first end of the body; a discharge outlet attached to a second end of the body; a mechanical attachment lug attached to the body between the first end of the body and the second end of the body; a pressure switch attached to the body between the mechanical attachment lug and the discharge outlet; and a wrap covering the body, wherein the wrap comprises high strength fiberglass; and wherein the fire extinguisher vessel has an agent fill density of at least about 0.026 pounds per cubic inch.

The fire extinguisher vessel of the preceding paragraph can optionally include, additionally and/or alternatively, any one or more of the following features, configurations and/or additional components:

The wrap comprises carbon fiber nano-tubes.

The wrap comprises carbon fiber reinforced fiberglass.

The wrap is flush with the fill port, the discharge outlet, the mechanical attachment lug, and the pressure switch.

The body is a hollow sphere comprising a nitrogen strengthened stainless steel alloy.

A method of retrofitting a fire extinguisher vessel includes removing a fire extinguisher vessel from a location on an aircraft, the fire extinguisher vessel including: a hollow body made of stainless steel; a fill port attached to a first end of the body; a discharge outlet attached to a second end of the body; a mechanical attachment lug attached to the body between the first end of the body and the second end of the body; and a pressure switch attached to the body between the mechanical attachment lug and the discharge outlet; wrapping a high strength fiberglass wrap around the body; and reinstalling the fire extinguisher vessel into the location on the aircraft.

The method of the preceding paragraph can optionally include, additionally and/or alternatively, any one or more of the following features, configurations and/or additional components:

The wrap is wrapped around the body such that the wrap is flush with the fill port, the discharge outlet, the mechanical attachment lug, and the pressure switch.

The fire extinguisher vessel has an agent fill density of at least about 0.026 pounds per cubic inch.

The wrap is wrapped around the body along the x-axis, the y-axis, and the z-axis of the body, wherein the axes are orthogonal axes.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fire extinguisher vessel comprising:
- a hollow body made of stainless steel;
- a fill port attached to a first end of the body;
- a discharge outlet attached to a second end of the body;
- a mechanical attachment lug connected to the body between the first end of the body and the second end of the body;
- a pressure switch attached to the body between the mechanical attachment lug and the discharge outlet; and
- a wrap covering the body, wherein the wrap is flush with the fill port, the discharge outlet, the mechanical attachment lug, and the pressure switch, and the wrap has a thickness between about 0.0625 inch and about 0.125 inch.

2. The fire extinguisher vessel of claim 1, wherein the wrap comprises fiber glass.

3. The fire extinguisher vessel of claim 1, wherein the wrap comprises carbon fiber reinforced fiberglass.

4. The fire extinguisher vessel of claim 1, wherein the wrap comprises carbon fiber nano-tubes.

5. The fire extinguisher vessel of claim 1, wherein the body is spherical.

6. The fire extinguisher vessel of claim 1, wherein the fire extinguisher vessel includes a plurality of mechanical attachment lugs connected to the body between the first end of the body and the second end of the body; and a plurality of discharge outlets attached to a second end of the body.

7. The fire extinguisher vessel of claim 1, wherein the fire extinguisher vessel has an agent fill density of at least about 0.026 pounds per cubic inch.

8. The fire extinguisher vessel of claim 1, wherein the body comprises a nitrogen strengthened stainless steel alloy.

9. The fire extinguisher vessel of claim 1, wherein the fire extinguisher vessel has an agent fill density of up to about 0.0336 pounds per cubic inch.

10. The fire extinguisher vessel of claim 1, wherein the wrap covers the body along all three orthogonal axes of the body.

11. A fire extinguisher vessel comprising:
- a hollow body made of stainless steel;
- a fill port attached to a first end of the body;
- a discharge outlet attached to a second end of the body;
- a mechanical attachment lug attached to the body between the first end of the body and the second end of the body;
- a pressure switch attached to the body between the mechanical attachment lug and the discharge outlet; and
- a wrap covering the body, wherein the wrap comprises fiberglass; and
- wherein the fire extinguisher vessel has an agent fill density of at least about 0.026 pounds per cubic inch.

12. The fire extinguisher vessel of claim 11, wherein the wrap comprises carbon fiber nano-tubes.

13. The fire extinguisher vessel of claim 12, wherein the wrap is flush with the fill port, the discharge outlet, the mechanical attachment lug, and the pressure switch.

14. The fire extinguisher vessel of claim 12, wherein the body is a hollow sphere comprising a nitrogen strengthened stainless steel alloy.

15. The fire extinguisher vessel of claim 11, wherein the wrap comprises carbon fiber reinforced fiberglass.

16. A method of retrofitting a fire extinguisher vessel comprising:
- removing a fire extinguisher vessel from a location on an aircraft, the fire extinguisher vessel including:
  - a hollow body made of stainless steel;
  - a fill port attached to a first end of the body;
  - a discharge outlet attached to a second end of the body;
  - a mechanical attachment lug attached to the body between the first end of the body and the second end of the body; and
  - a pressure switch attached to the body between the mechanical attachment lug and the discharge outlet;
- wrapping a fiberglass wrap around the body; and
- reinstalling the fire extinguisher vessel into the location on the aircraft.

17. The method of claim 16, wherein the wrap is wrapped around the body such that the wrap is flush with the fill port, the discharge outlet, the mechanical attachment lug, and the pressure switch.

18. The method of claim 16, wherein the fire extinguisher vessel has an agent fill density of at least about 0.026 pounds per cubic inch.

19. The method of claim 16, wherein the wrap is wrapped around the body along the x-axis, the y-axis, and the z-axis of the body, wherein the axes are orthogonal axes.

* * * * *